United States Patent [19]

Scala

[11] Patent Number: 5,067,384

[45] Date of Patent: Nov. 26, 1991

[54] BRAIDER METHOD AND APPARATUS FOR MANUFACTURED FAIRED ROPE OR CABLE

[75] Inventor: Eraldus Scala, Ithaca, N.Y.

[73] Assignee: Cortland Cable Company, Inc., Cortland, N.Y.

[21] Appl. No.: 299,774

[22] Filed: Jan. 23, 1989

[51] Int. Cl.[5] ..... D04C 3/10

[52] U.S. Cl. ..... 87/6; 87/7; 87/11

[58] Field of Search ..... 87/5–9, 87/11, 28, 29, 30, 13, 33, 41; 57/6

[56] References Cited

U.S. PATENT DOCUMENTS

| | | | |
|---|---|---|---|
| 2,196,900 | 4/1940 | Girard et al. | 87/30 |
| 2,354,212 | 7/1944 | Jeckel | 87/11 |
| 2,388,693 | 11/1945 | Jeckel | 87/11 X |
| 2,407,929 | 9/1946 | Jeckel | 87/11 |
| 2,494,389 | 1/1950 | Jeckel | 87/11 X |
| 3,975,980 | 8/1976 | Hood | 87/29 X |
| 4,030,401 | 6/1977 | Hood | 87/6 |
| 4,084,065 | 4/1978 | Swenson | 87/6 X |
| 4,311,079 | 1/1982 | Hood | 87/7 X |

*Primary Examiner*—Joseph J. Hail, III

*Attorney, Agent, or Firm*—Ralph R. Barnard

[57] ABSTRACT

Method and apparatus for manufacturing a braided jacket with fairing members on a cable core using a standard dual sinusoidal path braiding apparatus comprising apparatus to perform the following steps:

a) picking up a thread bundle from the selected bobbin-thread tensioning device in at least one sinusoidal pathway by using a hook above the bobbin-thread tensioning device through the use of an extension associated therewith; b) allowing the hook to pull a loop of the thread bundle by the action of the braiding operation; and c) cutting the loop of thread by a cutting edge mounted on the hook when the loop of thread moves up an incline in the hook to the location of the cutting edge as a part of the braiding operation; and d) the cut end of the thread loop being free of the braided jacket so as to function as fairing.

2 Claims, 4 Drawing Sheets

Fig.3
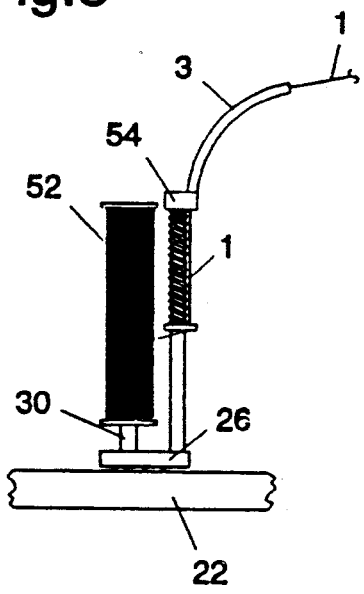
Fig.4a
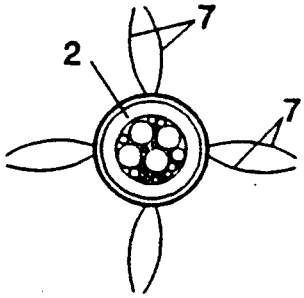
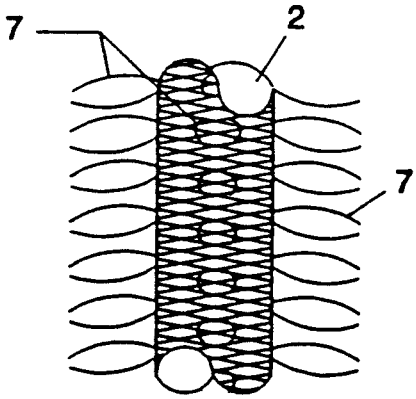
Fig 4b

BRAIDER METHOD AND APPARATUS FOR MANUFACTURED FAIRED ROPE OR CABLE

FIELD OF THE INVENTION

The present invention relates to the braiding art and more particularly a method for braiding tubular or line type and elongated products which include a requirement that the line, tube or elongated product have fairings or streamers extending laterally therefrom. More particularly, the present invention relates to method and apparatus for including in the braiding operation a step wherein the braiding material is extended in a loop and cut.

BACKGROUND OF THE INVENTION

During the conduct of oceanographic undersea surveillance and studies, it has been discovered that the hydrophone cable, as well as the guy cables, tend to vibrate when subjected to ocean currents. This strumming noise or sound produced by the vibrating cables are detected by the hydrophones, and the detected noise is known to interfere with the acoustic studies. In addition, it has been discovered that the strumming attracts fish, and fish have been known to attack the cable. Since it is desirable for such studies to conducted with a minimum of background noise, it should be apparent that a cable structure which does not have a proclivity to vibrate in response to ocean currents is highly desirable.

The fairing of cables in water in the sense of connecting lateral strands to cable, line or elongated structures has been used for many years and in earliest versions required attachment of the fairing material by hand operation such as connecting short pieces of line at intervals along the cable, etc.

It is known that the vibrations and hence the sound produced by vibrating undersea cables can be attenuated by providing those fairings or streamers at spaced intervals along the length of the cable. The fairings are normally fabricated of a flexible material which extends laterally of the cable so that each fairing is capable of disposing itself on the down-stream side of the cable to break-up vortices as the sea water flows across the cable. Thus the cause of cable strumming is eliminated or reduced and cable drag also tends to be reduced.

One type of faired cable which has been used comprises a series of flat relatively-narrow tapes or ribbons secured to the cable at spaced intervals along its length. Although this type of faired cable may function satisfactorily in certain situations, it has limitations. For instance, the tapes are highly flexible. As a result, they can wrap completely around the cable in response to changes in the direction of ocean currents. Needless to say, such wrapping is undesirable since it prevents the fairings from functioning properly. The tapes also have a proclivity for tearing and becoming disconnected from the cable during deployment and recovery. Furthermore, such a faired cable is expensive to manufacture.

As the technology of making rope and or cable developed layers including the outer layers were often produced by a category of apparatus known as a braiding machine which apparatus comprises a frame or base plate upon which is mounted a platen having a pair of complimentary sinusoidal grooves constituting a pair of endless sinusoidal paths disposed about a common axis. Supported in the grooves are a plurality of foot members each of which have a depending element adapted to be engaged by lugs, carried by gears or other suitable driving means disposed below the platen. Each foot member releasably supports a bobbin carrier which in turn supports a bobbin in position to feed thread therefrom through suitable thread guides and thread tensioning means. The details of the construction of the foot members, the mechanism for driving them and the bobbin carriers are no part of the present invention except that equivalent functioning elements are necessary to perform the methods disclosed herein as part of the present invention. For details of this mechanism and the general technology of braiding machines of the general type useful to practice braiding a jacket on a cable or core, reference is made to U.S. Pat. No. 2,388,693, issued Nov. 13, 1945, U.S. Pat. No. 2,354,212, issued July 25, 1944, U.S. Pat. No. 2,407,929, issued Sept. 17, 1946 and U.S. Pat. No. 2,494,389, issued Jan. 10, 1950. When all the plural bobbin carriers are disposed for movement along the sinusoidal paths of the machine the threads supported thereby are interwoven into the desired braid around the rope or core being passed upwardly along the common axis above the plurality of bobbins in the two sinusoidal paths. The bobbins in one sinusoidal path move in one direction and the bobbins in the other sinusoidal path move in the other direction. Each bobbin is providing a thread or a plurality of threads to the braid as the plurality of bobbins move around the common axis (and core material if present) to form a tubular braid material of the desired diameter determined in many applications by the size of the core material, if present. The apparatus described above is standard and in many braiding machines and a further description of one apparatus that works this way is shown in U.S. Pat. No. 2,388,693, etc. The number of bobbins can vary depending upon the application when the above described apparatus is operated to provide a braided tube or jacket tightly around the core of a cable or line (carrying electrical information) which needs the fairing material for the reasons stated above.

One way to provide fairing and avoid cable strumming have been to use polyester yarns or fibers for the final braided surface of the electrical cable because such polyester yarn or fibers have been selected because when they are brushed they provide a nap or moss effect on the cable which improves vortex shedding thus reduces strumming in low current velocities. In U.S. Pat. No. 4,084,065 dated Apr. 11, 1978, it is stated that this technique for reducing strumming is particularly suitable for acoustic sensor array applications. That technique does not provide a flexible solution to the problem because the fairing is limited to that which can be obtained from the lateral yarn or fibers which are generated by brushing the braided jacket.

In other prior art, U.S. Pat. No. 3,975,980 dated Aug. 24, 1976, the fairings are provided by a resilient fairing yarn which is fed toward the core and which is manipulated by a needle during braiding of the jacket to cause each fairing to have a base portion anchored between the jacket and the resilient layer of the core and streamer portions extending outwardly from the base portion. The needle is mounted for reciprocation parallel to the moving core upstream of the braider, and the fairing yarn passes through the eye of the needle and a first length is displaced through the path of movement of the braid yarns into engagement with a gripping assembly located downstream of the braid yarns. The gripping assembly holds the first length of fairing yarn so that as the needle retracts, another length of braid yarn is pulled through the. needle-eye. Continued operation of the braider causes the jacket to be applied around the portion of the fairing yarn engaged with the core, thereby forming the base portion for the next fairing. A control system is disclosed for synchronizing movement of the needle with the displacement of the rope and for adjusting of the spacing between the fairings. This technique works to provide fairing article whether or not there is a separately formed core. This technique does provide fairing yarn extending from the braided surface however, in some instances the strength of the fairing yarn or fairing material as separate pieces is subject to being pulled out by forces being applied to it, in other words the fair yarn or material is not integral with the material forming the braided jacket.

Still another U.S. Pat. No. 4,030,401, dated June 21, 1977, covers the product produced by the method of U.S. Pat. No. 3,975,980 herein.

Other prior art is described in U.S. Pat. No. 4,311,079 dated Jan. 19, 1982. Therein the faired article is manufactured by guiding a length of faring yarn into proximity with the upstream side of the ring of a braider, entraining the fairing yarn in an air stream directed across the path of movement of the braid yarns inside the braider ring, and causing the fairing yarn entrained therein to pass through the path of movement of the braid yarns as they advance around the braider ring, thereby enabling the braid yarns to form the fairing yarn into loops as the braid yarns form the jacket around the core. The apparatus for practicing this method is also described.

The problem with the prior art from the present inventor's point view is that the fairing material that is the material of like kind or similar kind that is associated with cables, ropes, lines and other elongated strength members requiring lateral fairing members in a fluid or water is that these members are not made an integral part of the core or the braided jacket. On reviewing the inherent problem of the prior art, the inventor felt such members could be made in an integral part of the braided jacket and the manufacture of the same would be simplified and the likelihood of the fairing material tearing or wearing away from the cable, rope line or elongated strength member would be decreased.

SUMMARY OF THE INVENTION

The braiding machine as exemplified by the dual sinusoidal path of bobbins and related thread tensioning means moving in opposite directions thereon in each path was analyzed and it was discovered that and a hook disposed radially on the common axis of the paths and the center line of the upwardly moving core (cable) on which a jacket was being braided could hook one of the threads or thread bundles coming off a selected thread tensioning means with a spooler guide upward extension thereon and form a loop of thread or thread bundle of thread integral with that thread or thread bundle as it is braided in the jacket and that the loop would move up the inclined plane of the hook where the loop can be cut by a cutting means through the action of the braider acting to force the thread or bundle of threads against the cutting means such as a knife or a heated element as the top of the loop is pulled against the same and the two ends of the thread (or thread bundle) that are not cut are integrated into the braided jacket as would happen by the normal unmodified action of the braider.

Furthermore, as the braiding continues with one hook and knife at a particular radial location, the braiding of the core will continue and fairing threads will be formed along a single line along the length of the finished braid and cable. Furthermore, if additional longitudinal lines of fairing threads are desired at other points on the circumference on the braided jacketed cable additional hooks and a related spooler guide extension on the related thread tensioning means in combination with a proper located cutting means will result in additional line of fairing threads being developed at another point on the circumference on the braided jacketed cable. For example, it is likely that improved fairing might be obtained by locating the four (4) hooks at 90 degree displacement around the common axis of the two (2) sinusoidal paths and perpendicular to the upward movement of the core (cable) as it moves up along the common axis to the point at which the jacket is being braided by the action of the braiding machine. The integration of the fairing material with and as a part of the braided jacket is additionally enhanced by having the core material pass through a source of bonding agent prior to it moving to the point upward along the common axis to the point were the braiding and integrated fairing materials are added.

Accordingly, it is a primary object of the present invention to provide a new and improved method of using a braiding machine to provide a braided jacket to elongated core material including a cable, rope or line wherein said braided jacket has fairing material extending laterally and like a stripe along its length at selected point or points on a circumference thereof where said fairing material is integrated with the thread material to which it is connected in the braided jacket.

It is still another object of the present invention to provide a new and improved method of using a braiding machine to provide a braided jacket wherein said braided jacket has fairing material extending laterally and like a stripe along its length at selected point or points on a circumference thereof where said fairing material is integrated with the thread material to which it is connected in the braided jacket.

It is an additional object of the present invention to provide a new and improved cable, rope or line, etc. with fairing material extending laterally therefrom at selected locations around the circumference and along the length thereof which fairing material is integrated with the braided jacket of said cable, rope or line in a manner such that the said fairing material would not easily tear or wear way from the braided jacket by the use of the new and improved method described herein.

The objects of the present invention are provided by a method of manufacturing an elongated structure (a cable) having a core and a plurality of flexible members extending outwardly from the core at spaced intervals along its length, as the advancing core moves up through the common axis of the two (2) endless sinusoidal paths of a plurality of moving bobbins with the direction of movement of the bobbins in each sinusoidal path being in the opposite direction and the bobbins in each path being distributed through 360 degrees and with each bobbin paying out threads through thread tensioning means for braiding thread material around the said elongated structure having a core as the elongated structure advances upwardly along the common axis with the plurality of flexible members extending outwardly from the core being obtained by the following steps:

(a) raising the level upward of the thread leaving the thread tensioning means associated with at least one bobbin paying out the thread to provide the flexible members extending laterally outward from the core by adding an spooler guide extension upward for the thread leaving the thread tensioning means;

(b) catching the thread leaving the said thread tensioning means via the spooler guide extension by disposing a hook, above the plural bobbins and associated thread tensioning means moving along the said sinusoidal paths in opposite directions, at a radial angle location corresponding to the point on the circumference of where the operator wished the flexible members extending laterally outward from the core are to be located at a height at which the hook will catch the thread coming off of the spooler guide extension but not the other thread tensioning means associated with the other bobbins moving in the two sinusoidal paths;

(c) and as said plurality of bobbins and thread tensioning means continue to move along the sinusoidal paths in opposite directions the thread so hooked moves up the inclined plane of the hook continuing to become an integral part of the braid over said core and the loop formed by that portion of the thread which does not become a part of the braid moves toward the top of the hook that reaches a point that the loop of thread is cut forming the laterally extended threads at the selected point of the circumference of the core determined by the aforesaid radial angle selected for the hook.

These and other objects, features and advantages of the present invention should become apparent from the following description when taken in conjunction with the accompanying drawings in which;

FIG. 1 gives a top view of a braiding machine of the prior art modified in accordance with the teachings of the present invention i.e. spooler guide extension upward connected to the thread tensioning means and on those cases where the thread tensioning means was associated with a bobbin dispensing thread through the thread tensioning means and which were going to be hooked by one of the hooks disposed at four (4) different radial angles around the common axis at the location of the core being provided braided jacket with lateral fairing members and cut from loops formed by the hooks;

FIG. 3 shows a single bobbin in more detail as it cooperates the thread tensioning means along with a spooler guide extension extending the thread path upward for appropriate engagement with the hook during travel in the sinusoidal path;

FIG. 4*a* and *b* show completed fairings on the braided jacket of the core in those cases where there are four (4) hooks disposed at approximately 90 degree radial angles around the common axis of the two (2) sinusoidal paths over which an equal number of spooler and thread tensioning combinations pass in uniform separation but in opposite directions.

Figure 5:
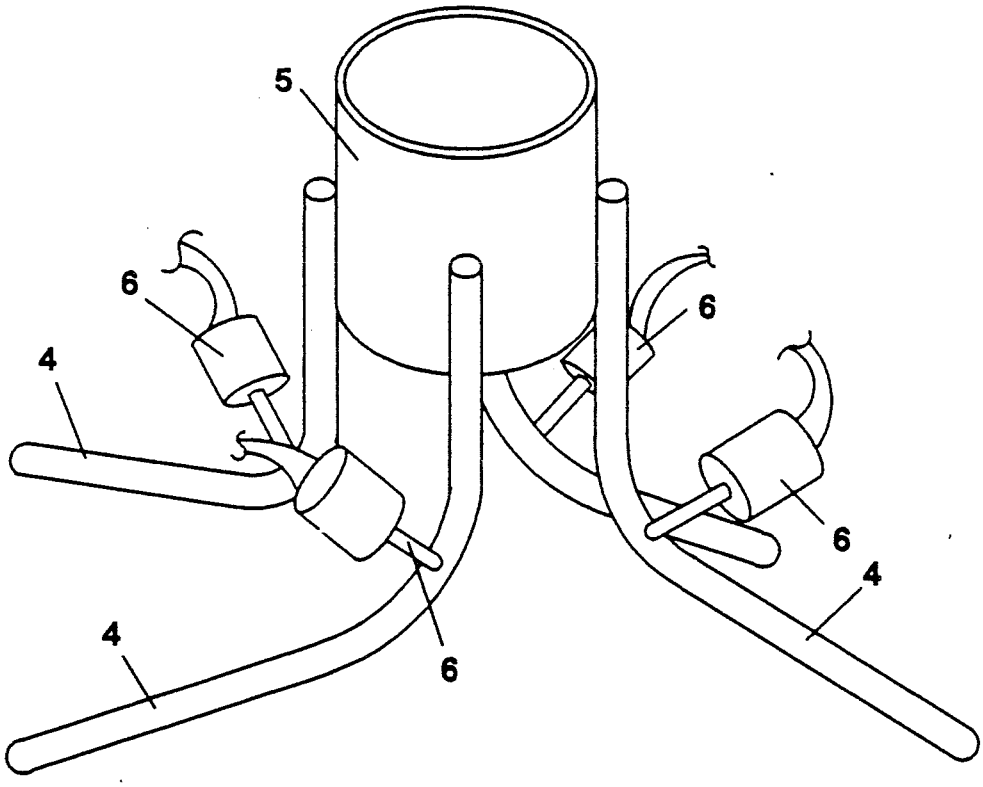

FIG. 4*a* shows a top view of the braided jacketed core with four (4) rows of two (2) threads and FIG. 4*b* shows a side view; and FIG. 5 is a collar on which is mounted the four (4) hooks in combination with a means for cutting the thread or thread bundle on each hook.

This invention relates to braided articles such as ropes, cables and lines having fairing streamers laterally therefrom and to a method and apparatus for producing those structures. More particularly, the invention relates to a method and apparatus wherein the fairing or streamers are made integrally with the braiding operation in that braid jacketing material threads are selected during the braiding operation to be elongated and cut as the threads are braiding.

As identified hereinabove, the solution of fairing often has its significant application when the cable, line or elongated structure to which the braided jacket is to be added along with fairing includes an electrical or fiber optic core in varying numbers and combinations as the specific application requires. For example, there might by 24 pairs of electrical wires and the electrical wires might be twisted together with a mylar wrap added as well as a braided strength member and braided protective jacket of synthetic material. If fairing is needed the braid might be included in the protective layer of braiding in accordance with the teachings of the present invention. It should be recognized that the teaching of the present invention could be utilized with only one layer of braiding.

DETAILED DESCRIPTION

Figure 1:
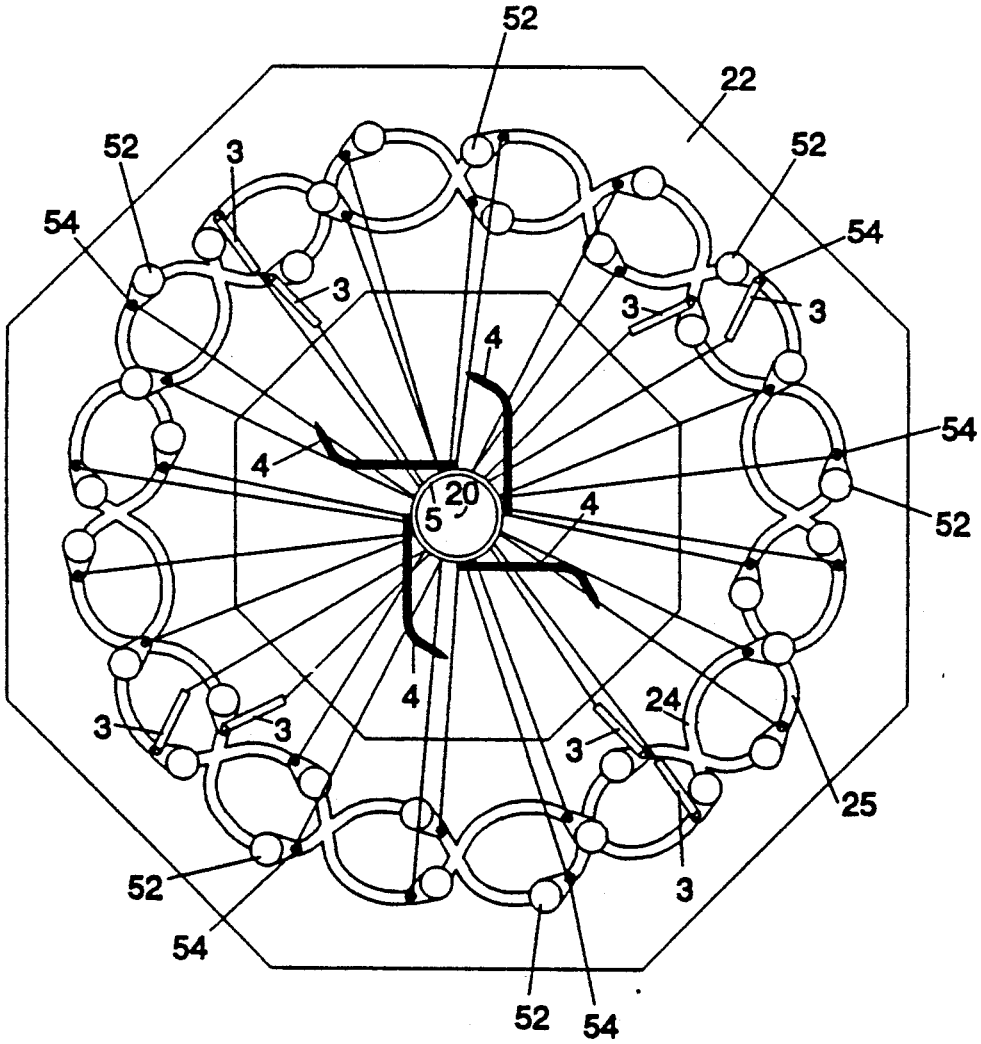
Figure 2:
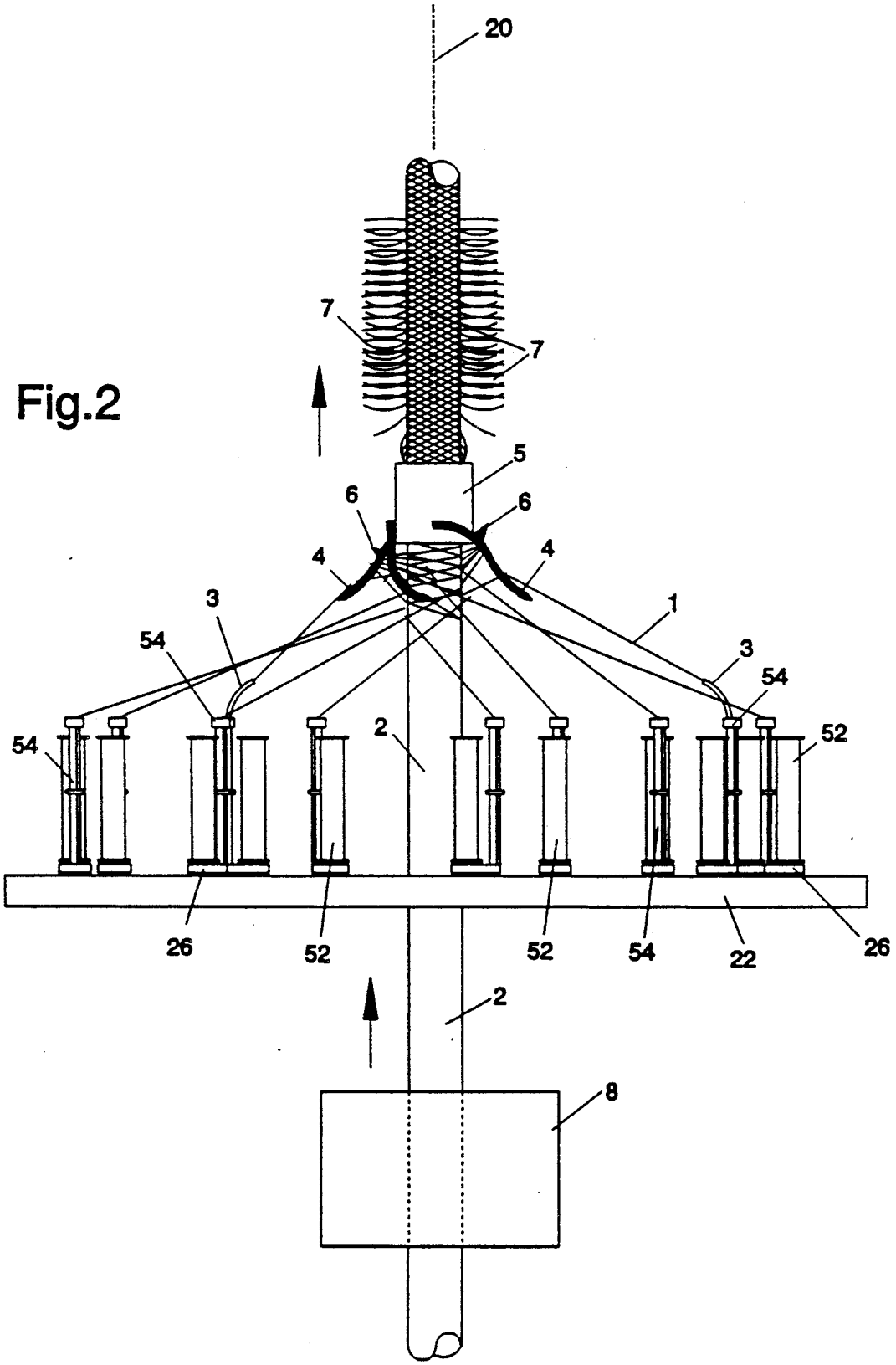
FIG. 2 shows a side view of the same teachings showing the lesser number of bobbin and thread tensioning combinations but included is the core being braided with a jacket.

Referring to FIG. 1 and FIG. 2, the braiding apparatus as shown from a top view and side view is described as follows: as comprising a platen 22 which is mounted on top of a frame and plural gear driving mechanisms which are not shown but will be discussed hereinafter and which do not form any specific part of the present invention since they are common to braiding machines of the type described in U.S. Pat. No. 2,388,693, etc. identified hereinabove. The platen contains a pair of complimentary sinusoidal grooves 24 and 25 constituting a pair of endless sinusoidal paths disposed about a common axis 20 and supported in the grooves are a plurality of foot members 26 each of which have a dependent element (not shown) as being on the other side of the platen 22 where each has a depending element (not shown) adapted to be engaged by lugs (not shown), carried by gears (not shown) or other driving means (not shown) disposed below the platen 22. Each foot member 26 releasably supports a bobbin carrier 30 which in turn supports a bobbin 52 in position to feed thread therefrom through suitable thread guides and tensioning means 54. The details of the construction of the foot members, the mechanism for driving them and the bobbin carriers are no part of the present invention except that equivalent functioning elements are necessary to perform the methods disclosed herein as part of the present invention. For details for mechanism described in the U.S. Pat. No. 2,388,693, etc. When all the plural bobbin carriers 30 are disposed for movement along the sinusoidal paths of the machine the threads 1 on the bobbins 52 supported thereby are interwoven into the desired braid around the rope or core 2 being passed upwardly along the common axis 20 above the plurality of bobbins 52 and thread tensioning means 54 in the two sinusoidal paths. The bobbins 52 in one sinusoidal path move in the one direction and the bobbins 52 in the other sinusoidal path move in the other direction. Each bobbin 52 is providing a thread 1 or a plurality of bundled threads 1 to the braid as the plurality of bobbins move around the common axis 20 and core material 2 to form a tubular braid material of the desired diameter determined by the size of the core material. The apparatus described up to this point with respect to FIG. 1 and 2 is standard in many braiding machines. For details of the mechanism described see U.S. Pat. No. 2,388,693 identified above. Moreover, the thread bundles can include relatively large number of threads 1. The number of bobbins can vary depending upon the application as the above described apparatus operated the braided tube or jacket may be tightly braided around the core of the cable or electrical core which needs the fairing material for the reasons stated above. To practice the present invention FIGS. 1 and 2 are supplemented to include the essential features of the teaching of the present invention. Each thread tensioning device 54 of selected bobbin and thread tensioning means combinations which are to provide thread as the laterally extending fairing material are extended by a spooler guide extension 3 upward so that the extended thread tensioning device 54 will cooperate with two of the four hooks 4 fixedly hanging from a collar 5 at approximately 90 degree angle around the common axis 20. The number of hooks you use would determine how many longitudinal lines of fairing materials you will obtain when you practice the method of this invention. When you want two longitudinal lines of fairing material you use two hooks at a appropriately located radial angle and each thread tensioning device 54 extended by a spooler thread extension will cooperate with one of the two hooks. If you want just one longitudinal line of fairing material you use just one hook and each thread tensioning device extended by a spooler thread extension will cooperate with just the one hook. The number of spooler thread extensions that you have for corresponding thread tensioning devices will be determined by how many of the bobbin-thread tensioning devices 52, 54 you want to assign to production of lateral fairing material as apposed to those bobbin-thread tensioning devices which you want to assign strictly to functioning to braid the jacket. When a spooler extension is connected to the thread tensioning device the tension on the thread tensioning device is decreased using standard technique.

It was discovered that a hook disposed radially on the common axis of the paths and the center line of the upwardly moving core on which a jacket was being braided could hook one of the threads or thread groups coming off a selected thread tensioning means 54 with a spooler guide upward extension 3 and form a loop of thread (or thread group) integral with that thread or thread group as it is braided in the jacket and that the loop would move up the inclined plane of the hook 4 where the loop would be cut by a cutting means 6 through the action of the braider acting against the cutting means 6 such a knife or a heated element as the top of the loop is pulled against the same and the two ends of the thread or thread group that are not cut are integrated into the braided jacket as would happen by the normal unmodified action of the braider. Furthermore, as the braiding continues with one hook and knife at a particular radial location the braiding of the jacket for the core will continue and the fairing threads 7 will be formed along a single line along the length of the finished cable 2. Furthermore, if additional longitudinal lines of fairing threads are desired at other points on a circumference on the braided jacketed cable, additional hooks 4 and related spooler guide extension 3 on the related thread means along with a proper cutting means will result in an additional line of fairing threads being developed at another point on the circumference on the braided jacketed cable. For example, it is likely that improved fairing might be obtained by locating the four (4) hooks 4 at 90 degree displacement around the axis of the common axis of the two (2) sinusoidal paths and perpendicular to the upward movement of the core 2 as it moves up along the common axis 20 to be to the point at which the jacket is being braided by the action of the braiding machine. The integration of the fairing material with and as a part of the braided jacket is additionally enhanced by having the core material 2 pass through a source of flowable adhesive prior to it moving upward along the common axis to the point where the braiding and integrated fairing materials are added.

FIG. 1, shows 32 bobbin-thread tensioning means combinations 52, 54 moving into sinusoidal paths around the common axis 16 in one path and 16 in the other but in opposite directions but at equal distance apart. Four hooks 4 are shown disposed around the common axis 20 accordingly, eight of the bobbin-thread tensioning means combination 52, 54 may have spooler thread extensions 3 attached thereto as shown. However in the actual equipment most used by the inventor to date, there are 24 bobbin-thread tensioning means combination 52, 54 moving in the sinusoidal paths around the common axis 12 in one path and 12 in the other path but in opposite directions but at equal distance apart. In each case however, since there are four hooks disposed at 90 degree radial angles around the common axis there could be as many as two equally spaced thread tensioning means 54 having spooler thread extensions attached thereto. The upper number of spooler extensions applied to the plurality of bobbin thread tensioning devices is set by how many of the strictly jacket producing bobbins you want to give up to produce fairing. A prior art braiding machine used by the inventor and modified as taught herein is a braiding machine Model No: SL-5-24, made by Kokubun, INC. Hamamatsu Japan, U.S. distributor Toyota Tsusho America Inc. Meadowland Parkway, SeCaucus, N.J. 07094.

The threads that were used with the bobbins associated with the spooler thread extensions have been yellow nylon and three threads were bundled as one and the threads that were used with bobbins not associated with the spooler thread extensions have been black polyester made up of sixteen threads bundled together. The actual number of threads to be bundled as well as the type of material use for threads is variable and subject to the judgment of the designer of the cable jacket and fairing.

The inventor has found it useful to adjust the tension in the thread tensioning means 54 which are associated with the spooler thread extensions by modestly decreasing the same. The adhesive added by passing the core 2 through bucket 8 is an important step in the process because such adds to the integrity of the laterally extending threads as being a part of the other threads in the braided jacket. Contact adhesive material that functioned acceptably among others is known generically as poly chlorophane latex and is available commercially.

The speed with which core 2 moves upward as shown in FIG. 2, has to be controlled with care and be coordinated with the rate at which the plurality of bobbin-thread tensioning means 52, 54 move at a constant speed through the two repetitive sinusoidal paths where a fraction of the threads are caught by the hooks for making lateral fairing threads and a much larger number of the threads are braiding the jacket in a conventional manner and at the same time providing the forces and packing and interweaving that integrates the threads that will become a part of the fairing with the remaining threads of the braided jacket all according to the teachings of the present invention.

Referring to FIG. 3, there is shown in detail the bobbin-thread tensioning means 52, 54 with the spooler thread extension 3. Also shown is a bobbin carrier 30 as well as a foot member 26, as well as a platen 22 the top surface gear drive mechanism box (not shown) which mechanism and motive force forms no detailed part of the present invention except that it is standard and it functions through the bobbin carrier etc. to, move the bobbins and thread tensioning means 52, 54 on their travel in the two sinusoidal paths which are repetitive and which are around a common axis 20. Reference is again made to U.S. Pat. No. 2,388,693, etc. as an example of a resource for the mechanism and the motive means.

FIG. 4*a* and *b*, show one example of the four lines of fairing threads that may be obtained according to the teachings of the present invention. More lines of fairing threads can be obtained as required following the teachings of the present invention by using more hooks and more spooler thread extensions and the quality of the lateral fairing threads can be modified by increasing the number of threads bundled on the bobbins being used for making fairing thread loops.

FIG. 5, depicts four hooks arranged on a collar 5 which have incline planes and are arranged at 90 degree radial angles around an axis which coincides with the common axis of the two sinusoidal paths when the arrangement is installed. The cutting tool 6 is shown as an electric heating device appropriately located on the hooks. The design can change within the spirit of the principles of the invention as described as hereinabove.

While I have shown and described by method in connection with the production of fairing it should be recognized this method may be performed in many variations in keeping with the spirit of the description herein. It is, therefore, to be understood that the present disclosure is to be regarded as illustrative of the invention only and not in restriction of the appended claims.

I claim:

1. A method of manufacturing an elongated structure having a core and a plurality of flexible members extending outwardly from the core at spaced intervals along its length, as the advancing core moves up through a common axis of two endless sinusoidal paths of a plurality of moving bobbins with the direction of movement of the bobbins in each sinusoidal path being in the opposite direction and the bobbins in each path being maintained evenly distributed through 360 degrees and with each bobbin paying out threads through thread tensioning means for braiding thread material around the said elongated structure having a core as the elongated structure advances upwardly along the common axis with the plurality of flexible members extending outwardly from the core being obtained by the following steps:

(a) raising the level upward of the thread leaving the thread tensioning means associated with at least one bobbin paying out thread to provide the flexible members extending laterally outward from the core by adding a spooler guide extension upward for the thread leaving the thread tensioning means;

(b) catching the thread leaving the said thread tensioning means via the spooler guide extension by disposing a hook, above the plural bobbins and associated thread tensioning means moving along the said sinusoidal paths in opposite directions, at a radial angle location corresponding to the point on the circumference of where the operator wishes the flexible members extending laterally outward from the core to be located and at a height at which the hook will catch the thread coming off of the spooler guide extension but not the other thread tensioning means associated with the other bobbins moving in the two sinusoidal paths;

(c) and as said plurality of bobbins and thread tensioning means continue to move along the sinusoidal paths in opposite directions the thread so hooked moves up the inclined plane of the hook continuing to become an integral part of the braid over said core and the loop formed by the portion of the thread which does not become a part of the braid moves toward the top of the hook that reaches a point that the loop of thread is cut forming the laterally extended threads at the selected point of the circumference of the core determined by the aforesaid radial angle selected for the hook.

2. A method of manufacturing a braided jacket with fairing members on a cable core using a standard dual sinusoidal path braiding apparatus including an elongated structure having a core and a plurality of flexible members extending outwardly from the core at spaced intervals along its length, as the advancing core moves up through a common axis of the two endless sinusoidal paths of a plurality of moving bobbins with the direction of movement of the bobbins in each sinusoidal path being in the opposite direction and the bobbins in each path being maintained evenly distributed through 360 degrees and with each bobbin paying out threads through thread tensioning means for braiding thread material around the said elongated structure having a core as the elongated structure advances upwardly along the common axis with the plurality of flexible fairing members extending outwardly from the core comprising the following steps:

(a) picking up a thread bundle from the selected bobbin-thread tensioning device in at least one sinusoidal pathway by using a hook means above said bobbin-thread tensioning device through the use of an extension means associated therewith;

(b) allowing said hook means to pull a loop of said thread bundle by the action of the braiding operation;

(c) cutting said loop of thread by a cutting means mounted on said hook means when said loop of thread moves up an incline in said hook means to the location of said cutting means as a part of the braiding operation; and (d) the cut end of said thread loop being free of said braided jacket so as to function as fairing means.

* * * * *